US006155807A

United States Patent [19]

Fenton

[11] Patent Number: 6,155,807

[45] Date of Patent: Dec. 5, 2000

[54] ECCENTRIC WORM PUMP

[75] Inventor: Gordon L. Fenton, New Carlise, Ohio

[73] Assignee: Seepex Seeberger GmbH & Co., Bottrop, Germany

[21] Appl. No.: 09/276,359

[22] Filed: Mar. 25, 1999

[30] Foreign Application Priority Data

Mar. 28, 1998 [DE] Germany ..... 198 13 999

[51] Int. Cl.[7] ..... F04C 2/00

[52] U.S. Cl. ..... 418/48; 418/104; 418/152; 418/153; 418/182

[58] Field of Search ..... 418/48, 182, 152, 418/153, 104

[56] References Cited

U.S. PATENT DOCUMENTS

| | | | |
|---|---|---|---|
| 3,844,800 | 10/1974 | Hooton | 106/36 |
| 5,108,273 | 4/1992 | Romanyszyn . | |
| 5,472,319 | 12/1995 | Rohlfing et al. | 417/307 |
| 5,759,019 | 6/1998 | Wood et al. | 418/48 |
| 5,769,618 | 6/1998 | Ono et al. | 418/48 |

FOREIGN PATENT DOCUMENTS

| | | | |
|---|---|---|---|
| WO 97/40273 | 10/1997 | European Pat. Off. . | |
| 2040748 | 8/1970 | Germany | 418/48 |
| 2 040 748 | 2/1972 | Germany . | |
| 3424212 | 6/1984 | Germany | 418/48 |
| 43 03 463 | 8/1984 | Germany . | |
| 9740273 | 10/1997 | WIPO | 418/48 |

*Primary Examiner*—Thomas Denion
*Assistant Examiner*—Theresa Trieu
*Attorney, Agent, or Firm*—Herbert Dubno; Andrew Wilford

[57] ABSTRACT

An eccentric worm pump has a tubular stator extending along a main axis and having an intake side and an output side, an eccentric worm fitting in the stator and centered on a rotor axis offset from the main axis, an intake housing forming an intake compartment opening into the intake side, a connecting shaft extending along the main axis from the rotor through the intake compartment, and a drive shaft extending along the main axis from the connecting shaft out of the intake compartment. The rotor, connecting shaft, and drive shaft are unitarily formed of plastic. A seal housing mounted on the intake housing seals around the drive shaft. A drive connected to the drive shaft rotates the drive shaft, connecting shaft, and rotor about the axis to draw fluid through the stator from the intake side to the output side thereof.

8 Claims, 1 Drawing Sheet

ECCENTRIC WORM PUMP

FIELD OF THE INVENTION

The present invention relates to an eccentric worm pump. More particularly this invention concerns such a pump having an eccentric worm rotor rotated about an axis in a stator to move a fluid axially.

BACKGROUND OF THE INVENTION

An eccentric worm pump as used for instance for pumping medicines, foodstuffs, dyes, and the like, typically has a tubular stator extending along a main axis and having an intake side and an output side, an eccentric worm fitting in the stator and centered on a rotor axis offset from the main axis, an intake housing forming an intake compartment opening into the intake side, and a connecting shaft extending along the main axis from the rotor through the intake compartment. A drive shaft extends along the main axis from the connecting shaft out of the intake compartment through a seal housing mounted on the intake housing and sealing around the drive shaft. A drive motor connected to the drive shaft rotates the drive shaft, connecting shaft, and rotor about the axis to draw fluid through the stator from the intake side to the output side thereof.

As the worm, which typically is formed with a rounded helicoidal ridge that fits with a complementary inwardly open groove of the stator, is centered on an axis offset from the main axis, it must in effect orbit about the main axis as it is rotated. Thus it is necessary to provide a universal or cardan joint at each end of the connecting shaft, connected on the downstream side to the rotor and on the upstream side to the drive shaft, to allow such movement of these parts which are all typically made of steel. These joints must be protected by flexible cuffs.

As a result such a pump is a very complex and expensive piece of equipment. While first costs are very high, when one of the couplings or its cuffs fails, repair costs are also quite elevated.

OBJECTS OF THE INVENTION

It is therefore an object of the present invention to provide an improved eccentric worm pump.

Another object is the provision of such an improved eccentric worm pump which overcomes the above-given disadvantages, that is which is of simple and inexpensive construction, but that is as effective and durable as the prior-art such pumps.

SUMMARY OF THE INVENTION

An eccentric worm pump has according to the invention a tubular stator extending along a main axis and having an intake side and an output side, an eccentric worm fitting in the stator and centered on a rotor axis offset from the main axis, an intake housing forming an intake compartment opening into the intake side, a connecting shaft extending along the main axis from the rotor through the intake compartment, and a drive shaft extending along the main axis from the connecting shaft out of the intake compartment. The rotor, connecting shaft, and drive shaft are unitarily formed of plastic. A seal housing mounted on the intake housing seals around the drive shaft. A drive connected to the drive shaft rotates the drive shaft, connecting shaft, and rotor about the axis to draw fluid through the stator from the intake side to the output side thereof. According to the invention the unitary worm, connecting shaft, and drive shaft are formed between the worm and the connecting shaft and between the connecting shaft and the drive shaft with flex regions of reduced cross section.

This arrangement therefore completely eliminates the need for complex joints between the ends of the connecting shaft and the rotor and drive shaft. Instead the one-piece assembly can flex along the connecting shaft, which according to the invention is along its entire length of smaller cross section than the drive shaft and the rotor so that the entire connecting shaft can flex, or the assembly can bend at the regions of reduced cross-sectional size. Such a pump is extremely easy to maintain aseptic for use in the food and medicine industries. It can nonetheless produce relatively high pressures, as much as 24 bar. In addition the rotor according to the invention can be substituted in an existing pump in place of the prior-art assembly comprising three different parts interconnected by two couplings.

In accordance with the invention the stator also can be made of plastic, preferably an elastomer. Thus the pump will be extremely simple and easy to clean.

The plastic according to the invention is reinforced with glass fibers. It can be a polyamide, preferably Nylon 66. This synthetic resin is very durable and does not absorb aromatics, so it is ideal when the pump is used for conveying solvent-containing substances. Alternately the plastic can be polytetrafluoroethylene, preferably containing by weight 10% to 15% graphite. This resin is known for its low friction and self-lubricating properties.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
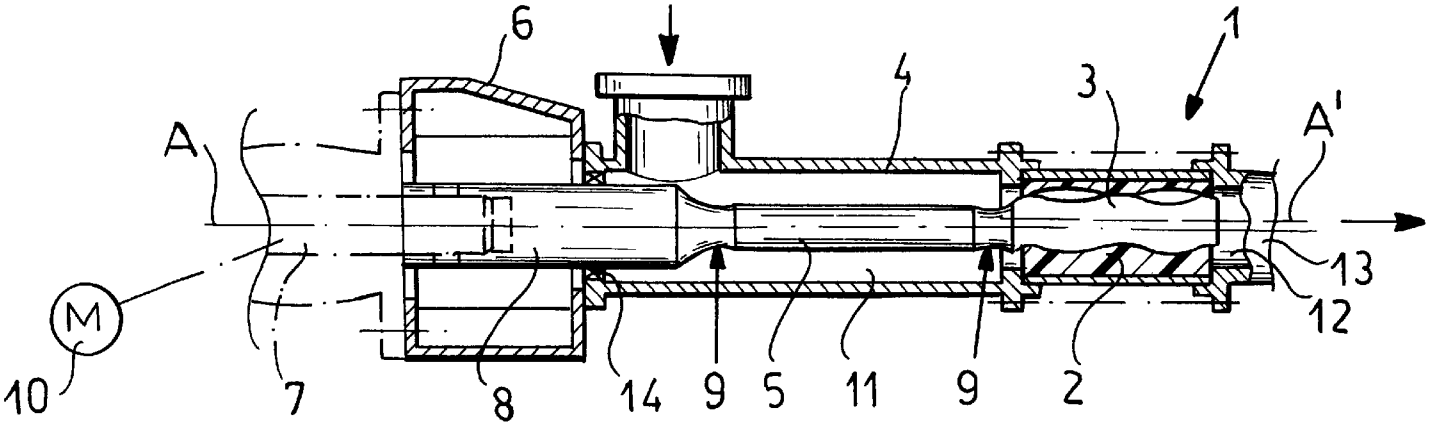
FIG. 1 is a small-scale partly diagrammatic axial section through the pump according to the invention.

As seen in FIG. 1 an eccentric worm pump 1 has a stator 2 centered on a horizontal axis A and surrounding an eccentric worm 3 centered on an axis A' offset slightly from but parallel to the axis A. Rotation of the rotor 3 about the axis A will cause fluid to be sucked left to right as seen in the drawing from an intake compartment 11 formed by an intake housing 4 to an outlet compartment 12 formed by an outlet housing 13. This is generally standard construction.

Figure 2:
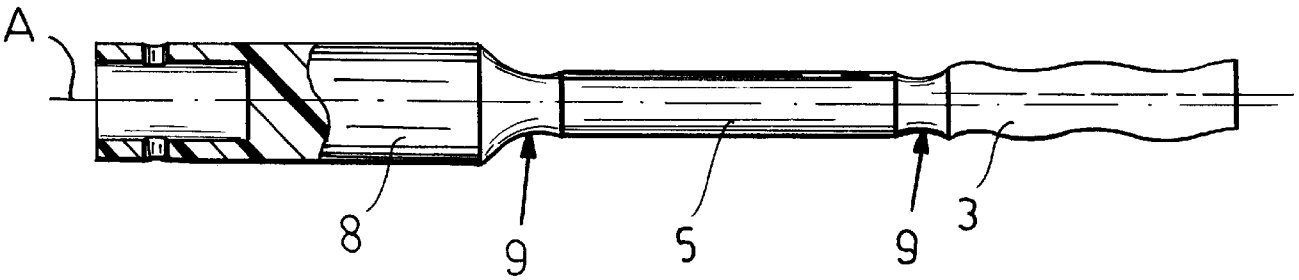
FIG. 2 is a partly sectional side view of the pump rotor.

As also shown in FIG. 2 the rotor 3 is unitarily formed with a small-diameter cylindrical connecting shaft 5 that extends through the intake compartment 11 and that is joined in turn to a large-diameter cylindrical drive shaft 8 projecting out of the intake compartment 11 through a seal 14 into a seal compartment where it is joined to an output shaft 7 of a drive motor 10. The shaft 8 is centered on the axis A. The rotor 3, connecting shaft 5, and drive shaft 8 are all unitarily formed of a synthetic resin, here a polyamide, Nylon 66 that is reinforced with glass fibers, or polytetrafluoroethylene with 10% to 15% graphite. It is formed between the rotor 2 and connecting shaft 5 and between this connecting shaft 5 and drive shaft 8 with regions 9 of reduced diameter formed as outwardly open circular-section annular grooves that impart some flexibility to the one-piece assembly 3, 5, 8 at these regions 9.

The stator 2 is also according to the invention formed of a synthetic resin, preferably one that is somewhat elastomeric so it can fit tightly to the worm 3 where needed.

I claim:

1. An eccentric worm pump comprising:

a tubular stator extending along a main axis and having an intake side and an output side;

an eccentric rotor worm fitting in the stator and centered on a worm axis offset from the main axis;

an intake housing forming an intake compartment opening into the intake side;

a connecting shaft extending along the main axis from the worm through the intake compartment;

a drive shaft extending along the main axis from the connecting shaft out of the intake compartment, the worm, connecting shaft, and drive shaft being unitarily formed of plastic with a flex region of reduced cross section between the connecting shaft and the drive shaft another flex region of reduced cross section between the connecting shaft and the worm, the connecting shaft being of greater cross section than either of the flex regions along its entire length;

a seal housing mounted on the intake housing and sealing around the drive shaft; and drive means connected to the drive shaft for rotating the drive shaft, connecting shaft, and worm about the worm axis and thereby drawing fluid through the stator from the intake side to the output side thereof.

2. The eccentric worm pump defined in claim 1 wherein the plastic is reinforced with glass fibers.

3. The eccentric worm pump defined in claim 1 wherein the plastic is a polyamide.

4. The eccentric worm pump defined in claim 3 wherein the polyamide is Nylon 66.

5. The eccentric worm pump defined in claim 1 wherein the plastic is polytetrafluoroethylene.

6. The eccentric worm pump defined in claim 5 wherein the plastic contains by weight 10% to 15% graphite.

7. The eccentric worm pump defined in claim 1 wherein the connecting shaft is along its entire length of smaller cross section than the drive shaft and the worm, whereby the entire connecting shaft can flex.

8. The eccentric worm pump defined in claim 1 wherein the stator is also made of plastic.

* * * * *